US005121169A

United States Patent [19]

Kawabata

[11] Patent Number: 5,121,169

[45] Date of Patent: Jun. 9, 1992

[54] RECORDING PAPER LENGTH SENSING APPARATUS

[75] Inventor: Takashi Kawabata, Isehara, Japan

[73] Assignee: Ricoh Company, Ltd., Tokyo, Japan

[21] Appl. No.: 605,275

[22] Filed: Oct. 30, 1990

[30] Foreign Application Priority Data

Nov. 1, 1989 [JP] Japan ..... 1-282892

[51] Int. Cl.[5] ..... G03G 21/00

[52] U.S. Cl. ..... 355/311; 271/171

[58] Field of Search ..... 355/311, 72, 74, 75, 355/309, 24, 26; 271/171, 3.1, 9

[56] References Cited

U.S. PATENT DOCUMENTS

| | | | |
|---|---|---|---|
| 4,008,957 | 2/1977 | Summers | 271/9 X |
| 4,277,165 | 7/1981 | Wada et al. | 355/72 X |
| 4,382,674 | 5/1983 | Miyoshi et al. | 355/311 |
| 4,553,831 | 11/1985 | Dixon | 355/72 X |
| 4,579,333 | 4/1986 | Aoki | 271/171 X |
| 4,603,962 | 8/1986 | Dekura | 355/311 |
| 4,696,563 | 9/1987 | Shibusawa | 355/311 |
| 4,702,589 | 10/1987 | Ito | 355/24 |
| 4,711,556 | 12/1987 | Abuyama | 355/309 X |
| 4,780,740 | 10/1988 | Fukae | 355/311 |
| 4,864,368 | 9/1989 | Muramatsu | 355/309 |
| 4,940,222 | 7/1990 | Maeno et al. | 271/127 |
| 4,942,814 | 7/1990 | Sugiyama | 355/311 X |

*Primary Examiner*—R. L. Moses

*Attorney, Agent, or Firm*—Oblon, Spivak, McClelland, Maier & Neustadt

[57] ABSTRACT

A recording paper length sensing apparatus for sensing a length of recording paper being fed in a paper feeding direction to an image forming apparatus. The recording paper length sensing apparatus comprises a table part on which the recording paper is loaded, the table part having a movable member and a fixed member and being mounted to a portion of the image forming apparatus to feed the recording paper to the image forming apparatus, a position of the movable member relative to the fixed member being adjustable to make an end portion of the movable member accord with a recording paper edge, a switching part for detecting a predetermined position of the movable member, the switching part being turned ON to generate a signal indicative of the recording paper length when the predetermined position of the movable member is detected, and a control part responsive to the signal from the switching part for recognition of the recording paper length. According to the present invention, it is possible to detect the length of recording paper having several different sizes by a single paper table unit, without using several paper cassettes for several different paper sizes.

5 Claims, 8 Drawing Sheets

LEGAL
B4
A4
LETTER
32
32
32
32
2

350mm
300mm
250mm
32
32
32
2

12 INCH
11 INCH
10 INCH
32
32
32
2

RECORDING PAPER LENGTH SENSING APPARATUS

BACKGROUND OF THE INVENTION

The present invention generally relates a to recording paper length sensing apparatus, and more particularly to a recording paper length sensing apparatus which automatically senses a length of recording paper in the form of a cut sheet used by an image forming apparatus such as a printer, a facsimile or the like.

Conventional image forming apparatuses such as a printer, a facsimile or the like, ordinarily employ recording paper in the form of a cut sheet together with a number of paper cassettes which can accommodate many sheets of the recording paper. These paper cassettes have a specific fixed size in accordance with the respective sizes of recording paper in which an image is recorded by the image forming apparatus. Before using the image forming apparatus, an operator must select a paper cassette having an appropriate size, which is in accordance with that of recording paper to be used, from among those paper cassettes and must mount the selected paper cassette into the image forming apparatus. Therefore, the above described image forming apparatus which uses the paper cassette having a size appropriate for that of recording paper requires a number of paper feed inlets to which several paper cassettes are mounted for different recording paper sizes and requires a number of paper feeding mechanisms for supplying paper from the paper cassette to an image forming mechanism within the image forming apparatus. To meet these requirements fully, it is unavoidable that the size of image forming apparatus becomes great and the manufacturing cost thereof becomes high. And, with the paper cassettes being used in the image forming apparatus, it is difficult to make use of recording paper which has a size different from those sizes of regular paper and, in the case of the above described image forming apparatus which uses the paper cassette having a specific fixed size, a user often experiences difficulty in using a recording paper which has a size different from standard paper sizes which are predetermined with the paper cassettes, for example, A4 size, B4 size, Letter size or the like.

SUMMARY OF THE INVENTION

Accordingly, it is a general object of the present invention to provide a novel and useful recording paper length sensing apparatus in which the above described problems are eliminated.

Another and more specific object of the present invention is to provide a recording paper length sensing apparatus for sensing a length of recording paper being fed along a paper feeding path to an image forming apparatus, the recording paper length sensing apparatus comprising a table part on which the recording paper is placed, the table part having a movable member and a fixed member and being mounted to a portion of the image forming apparatus to feed the recording paper to the image forming apparatus, a position of the movable member being adjusted relative to that of the fixed member such that a recording sheet edge accords with an end portion of the movable member, a sensing part for sensing a predetermined position of the movable member of the table part, the sensing part being turned ON to generate a signal when the predetermined position of the movable member is sensed, and a control part responsive to the signal supplied from the sensing part for allowing recognition of the length of the recording paper. According to the present invention, it is possible to detect the size of recording paper by means of a single recording paper table, without using several paper cassettes which accommodate recording paper for each of several different sizes. As the result, it is no longer necessary to provide an image forming apparatus having several paper feeding mechanisms and several mounting inlets for receiving several paper cassettes for different paper sizes. This allows provision of a small-sized product design and promotes reduction of the manufacturing cost. Further, it is advantageous that a size of recording paper which can be applied to the present apparatus is not limited to standard sizes only, and that another recording paper having a size different from standard sizes can be used.

Other objects and further features of the present invention will become apparent from the following detailed description when read in conjunction with the accompanying drawings.

DESCRIPTION OF THE PREFERRED EMBODIMENT

First, a description will be given of the present invention. As described above, the conventional image forming apparatus requires several paper cassettes for using recording paper of several different sizes However, according to the present invention, it is possible to detect the recording paper length by means of a single recording paper table. In the present invention, one or more paper length sensing devices are provided at prescribed positions on a recording paper table on which recording paper is loaded, said paper length sensing devices being aligned in a row along a paper feeding path. A signal indicative of a predetermined position of a recording paper is generated by each of the paper length sensing devices, and a combination of the signals from the paper length sensing devices is supplied to a control part of the image forming apparatus, allowing the image forming apparatus to recognize the recording paper length. In the present invention, when recording paper of a size different from that of the currently used recording paper or from the standard paper sizes is loaded on the recording paper table, the paper length sensing devices which are aligned in a row on the recording paper table along the paper feeding path supply a combination of the signals indicative of the recording paper length to the control part of the image forming apparatus, allowing the image forming apparatus to recognize the recording paper length. Therefore, according to the present invention, it is possible to easily detect the length of recording paper not only in the case of the standard paper sizes but also in the case of a recording paper size different from the standard paper sizes.

Figure 1A:
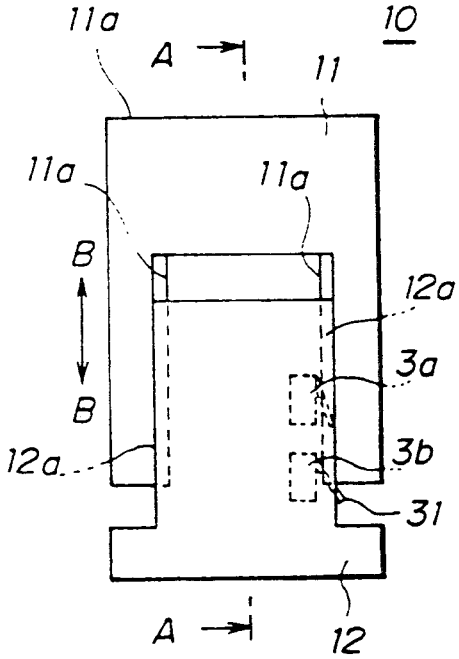
FIG. 1A is a top view showing the construction of a first embodiment of a recording paper length sensing apparatus according to the present invention.
Figure 1B:
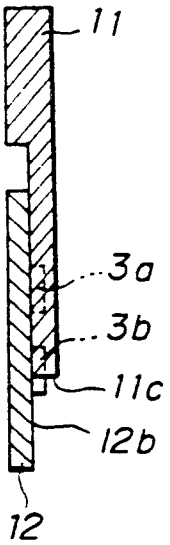
FIG. 1B is a sectional side view of the recording paper length sensing apparatus taken along a line A—A as indicated in FIG. 1A.

Next, a description will be given of a first embodiment of a recording paper length sensing apparatus according to the present invention, with reference to FIGS. 1A and 1B. FIG. 1A is a top view showing the construction of the recording paper length sensing apparatus of this embodiment, and FIG. 1B is a sectional side view of the recording paper length sensing apparatus taken along a line A—A as indicated in FIG. 1A. As shown in FIGS. 1A and 1B, a recording paper table 10 generally has a movable table 11 and a fixed table 12. The movable table 11 has projections 11*a* and the fixed table 12 has longitudinally extending side grooves 12*a*. The projections 11*a* of the movable table 11 are connected to the side grooves 12*a* of the fixed table 12 so that the movable table 11 is slidable in a direction B—B, indicated by an arrow in FIG. 1A, with respect to the fixed table 12. The movable table 11 has a front end surface 11*c* and a rear end surface 11*d*. When the movable table 11 stops at a position, the movable table 11 is fixed at that position with respect to the fixed table 12 by a suitable connecting member (not shown).

The fixed table 12 has a reverse side surface 12*b* on a side of the fixed table 12 opposite to a front side surface thereof on which recording paper is placed. On this reverse side surface 12*b* of the fixed table 12, a plurality of paper length sensors are aligned in a row along a longitudinal direction of the fixed table 12. In this first embodiment shown in FIGS. 1A and 1B, only two paper length sensors 3*a* and 3*b* are provided on the reverse side surface 12*b* of the fixed table 12. As the paper length sensors, for example, conventional microswitches, actuator-type photosensors or the like are usable, and, in this first embodiment, microswitches 3*a* and 3*b* each having a switch pawl 31 are used. In accordance with the length of recording paper installed on the movable table 11, that is, a movement position of the movable table 11 relative to the fixed table 12, the microswitches 3*a* and 3*b* are turned on and off. In other words, the microswitches 3*a* and 3*b* are turned on when the front end surface 11*c* of the movable table 11 connects to the switch pawl 31, and when the front end surface 11*c* does not connect to the switch pawl 31 the microswitches 3*a* and 3*b* are turned off.

Figure 2A:
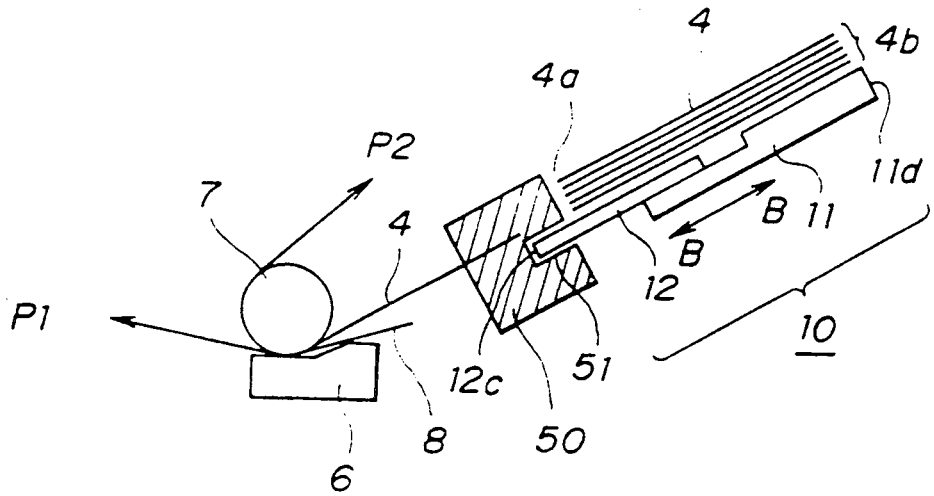
FIG. 2A is a side view showing the construction of the recording paper length sensing apparatus which is mounted to an image forming apparatus.
Figure 2B:
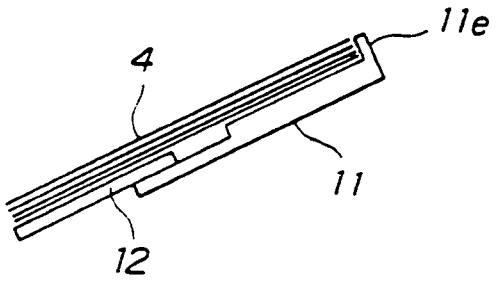
FIG. 2B is a side view of the recording paper length sensing apparatus shown in FIG. 2A.

FIGS. 2A and 2B show a construction of an embodiment of the recording paper table 10 which is mounted to a thermal transfer type recording apparatus using recording paper 4 in the form of cut sheet. This thermal transfer type recording apparatus which is a kind of image forming apparatus must recognize the length of the recording paper 4 by means of a control circuit provided therein (not shown) before a recording part starts a recording operation. In this embodiment of the recording paper table 10, as shown in FIG. 2A, a positional adjustment of the movable table 11 with respect to the length of the recording paper 4 must be performed allowing the rear end surface 11*d* of the movable table 11 to match with a position where a rear end 4*b* of the recording paper 4 being loaded on the recording paper table 10 is located. In this case, provision of a guide part 11*e* at a rear end portion of the movable table 11, as shown in FIG. 2B, will facilitate the positional adjustment described above. Depending on the length of the recording paper 4, the movable table 11 is moved relative to the fixed table 12 in a direction B—B, as indicated by an arrow in FIG. 2A. A front end portion 12*c* of the fixed table 12 is placed into an inlet opening 51 of an automatic sheet feeder (ASF) 50 of the thermal transfer type recording apparatus. In accordance with the length of the recording paper 4 at this position thus adjusted, the paper length sensors 3*a* and 3*b* are turned ON and OFF. For example, in a case where both the paper length sensor 3*a* and 3*b* are turned ON the recording paper 4 is a Letter size paper, and in a case where the paper length sensor 3*a* is turned ON and the paper length sensor 3*b* is turned OFF the recording paper 4 is a Legal size paper.

In addition, when the image forming apparatus uses two sizes of recording paper only, only one paper length sensor which is either one of the sensors 3*a* and 3*b* as shown in FIGS. 1A and 1*b*, may be used in the recording paper length sensing apparatus. It is possible to sense the length of recording paper only with the ON/OFF state of one paper length sensor.

As shown in FIG. 2A, a cut sheet of the recording paper 4 is fed from the recording paper table 10 to the recording part of the image forming apparatus by the ASF 50, the recording part comprising a thermal head 6 and a platen roller 7. At this recording part, an ink sheet 8 is provided beneath the recording paper 4 on a side of the thermal head 6, and an image is thermally transferred to the recording paper 4 through the ink sheet 8 by the thermal head 6. The ink sheet 8 is fed to an ink sheet roller (not shown) in a direction P1 as indicated in FIG. 2A. After the thermal transfer of the image to the recording paper 4 is completed, the recording paper 4 is fed to an ejection part by the platen roller 7 in a direction P2 as indicated in FIG. 2A.

Figure 7:
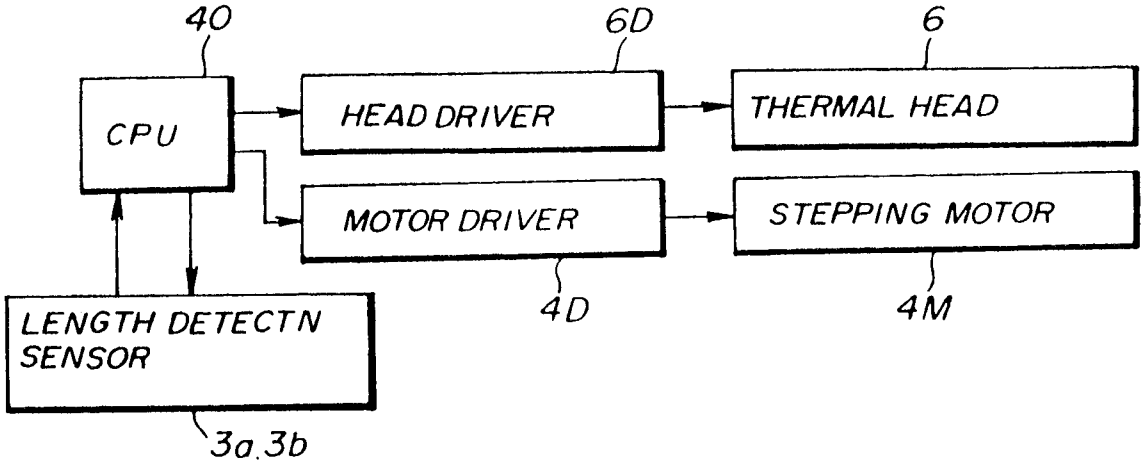
FIG. 7 is a system block chart for explaining the operation of the recording paper length sensing apparatus shown in FIGS. 2A and 2B.

FIG. 7 shows a system block chart for explaining the operation of the recording paper length sensing apparatus shown in FIGS. 2A and 2B. A signal, indicative of the length of recording paper, which is supplied from the paper length sensors is supplied to a microcomputer or central processing unit (CPU) 40 which is provided in a control circuit of the image forming apparatus. In accordance with this signal from the paper length sensors, the control circuit which includes the CPU 40 controls both operations of a head driver 6D for driving the thermal head 6 and a motor driver 4D for driving a stepping motor 4M so that a thermal transfer of an image to the recording paper is carried out appropriately by the recording part of the image forming apparatus at a controlled time.

Figure 3A:
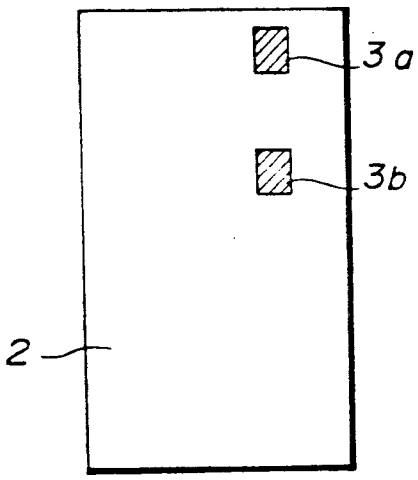
FIGS. 3A and 3B are a top view and a side view, respectively, showing the construction of a second embodiment of a recording paper length sensing apparatus according to the present invention.
Figure 3B:
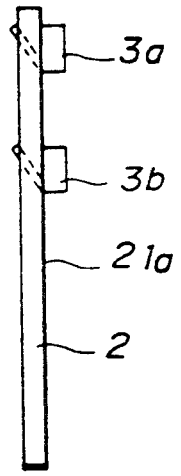

FIGS. 3A and 3B show the construction of a second embodiment of a recording paper length sensing apparatus according to the prevent invention. FIGS. 3A and 3B are a to view and a side view, respectively, showing the construction of this second embodiment of the recording paper length sensing apparatus. As shown in FIGS. 3A and 3B, the recording paper length sensors 3*a* and 3*b* are aligned in a row in a longitudinal direction thereof on a front side surface 21*a* of a recording paper table 2 on which recording paper is loaded. In this second embodiment shown in FIGS. 3A and 3B, only the two paper length sensors 3*a* and 3*b* are shown, but, it possible to provide three or more paper length sensor sin the recording paper length sensing apparatus according to the present invention.

Figure 4:
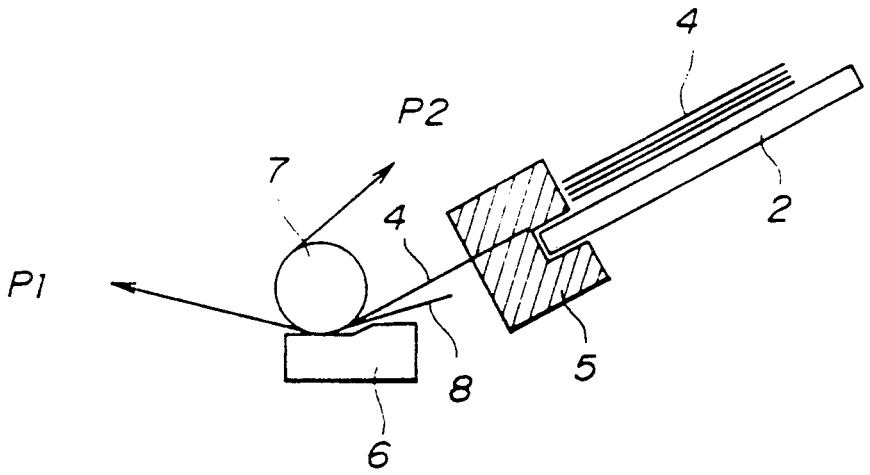
FIG. 4 is a side view showing the construction of the second embodiment of the recording paper length sensing apparatus which is mounted to an image forming apparatus.

FIG. 4 shows the construction of the second embodiment of the recording paper and length sensing apparatus which is mounted on a thermal transfer type recording apparatus. Similarly to the apparatus shown in FIGS. 2A and 2B, it is possible to sense the length of recording paper by a combination of ON/OFF states of the paper length sensors 3*a* and 3*b*. The operation of this second embodiment of the recording paper length sensing apparatus shown in FIG. 4 is similar to that of the apparatus shown in FIG. 7, and a description thereof will be omitted.

Next, a description will be given of a modified example of the paper length sensor provided in the recording paper length sensing apparatus, with reference to FIGS. 5, 8 and 9. This modified example is a paper length detection sensor 9 for detecting a leading edge 4*a* of recording paper 4 loaded on a recording paper table and detecting a rear edge 4*b* thereof, and, in place of the above described paper length sensors, this paper length detection sensor 9 is provided, as shown in FIG. 5, at a position between an automatic sheet feeder (ASF) 5 and a recording part of the image forming apparatus which comprises a thermal head 6 and a platen roller 7.

Figure 5:
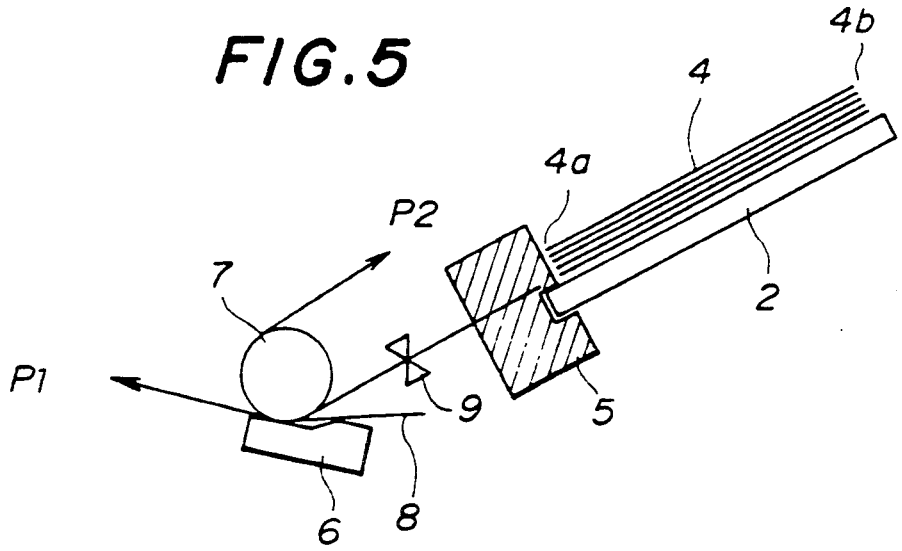
FIG. 5 is a side view showing the construction of a modified example of recording paper length sensing apparatus.
Figure 8:
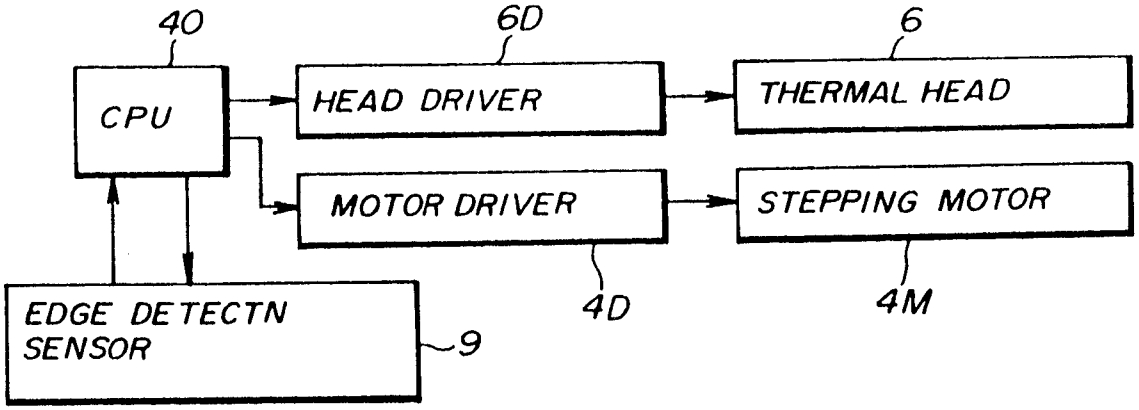
FIGS. 8 9 are a system block chart and a flow chart, respectively, for explaining the operation of the recording paper length sensing apparatus shown in FIG. 5.
Figure 9:
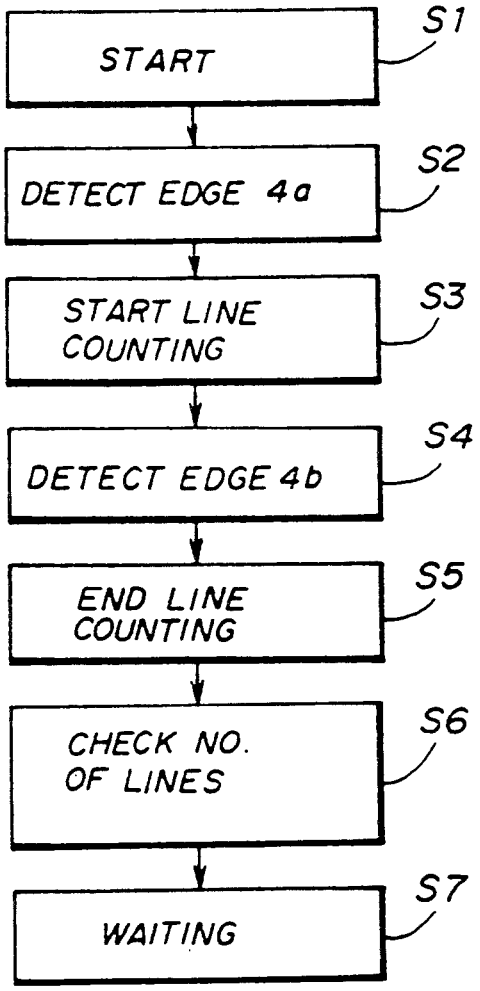

FIGS. 8 and 9 are a system block chart and a flow chart, respectively, for explaining the operation of the recording paper length sensing apparatus shown in FIG. 5. In a paper length detection cycle procedure as shown in FIG. 9, a step S1 starts this paper length detection cycle procedure. A step S2 checks that the paper length detection sensor 9 detects an leading edge 4*a* of the recording paper 4 which is fed from the ASF 5 to the recording part of the image forming apparatus. A step S3 starts a counting of the number of lines (text lines or graphics lines) by the CPU 40, and when a step S4 checks that the paper length detection sensor 9 detects a rear edge 4*b* of the recording paper 4, a step S5 terminates the counting of the number of the lines by the CPU 40. Then, a step S6 allows the CPU 40 to recognize the number of the lines which can be recording by the image forming apparatus. In the method which is described above with reference to FIG. 7, a thermal transfer of an image to the recording paper 4 is carried out. Finally, a step S7 puts the recording paper length sensing apparatus in a waiting state in which a length detection of a next recording sheet is awaited. This paper length detection cycle procedure is carried out on several occasions. These occasions include, for example, a case where the apparatus is turned on and off, a case where a recording paper is newly loaded on the recording paper table after detecting that no recording paper is found on the recording paper table, a case where a jammed paper is removed and the recording paper is loaded again on the recording paper table, a case where a recording paper of a different size from that of the currently used recording paper is newly loaded on the recording paper table. Carrying out this paper length detection cycle procedure enables recognition of the length of recording paper which is placed on the recording paper table. Further, it is advantageous that this paper length detection cycle procedure can be performed for detecting cycle procedure can be performed for detecting the length of a recording paper having an arbitrary size different from standard sizes of recording paper such as A4 size, B4 size, Letter size or the like.

Figures 6A, 6B, 6C:
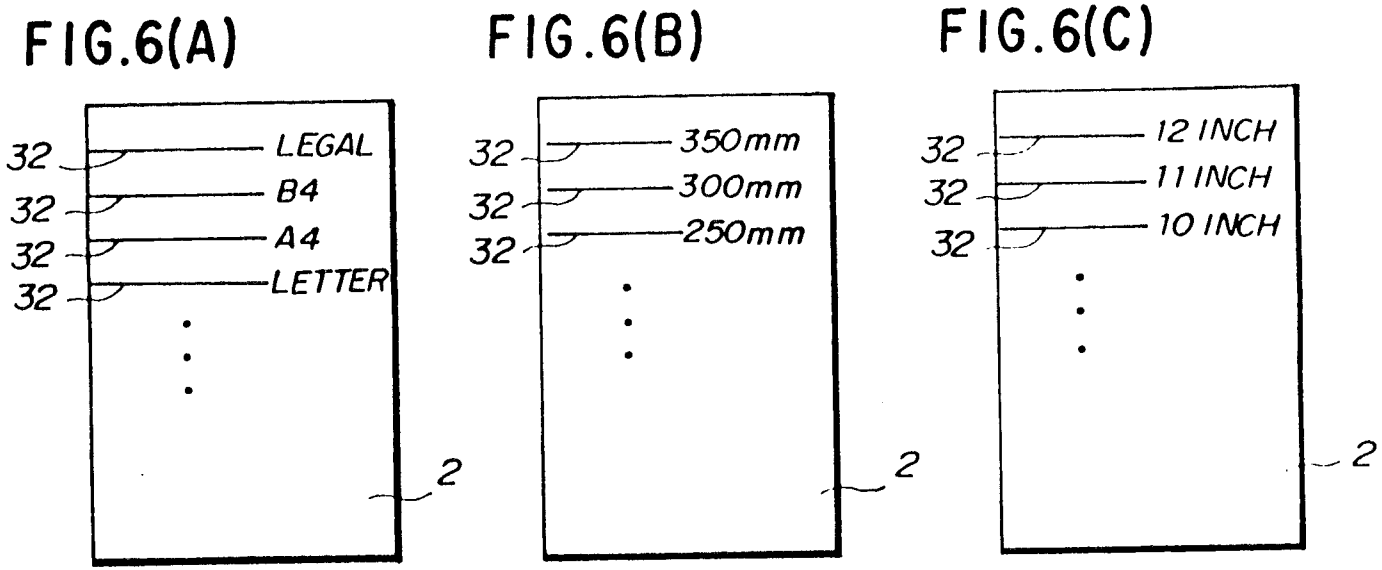
FIGS. 6A, 6B and 6C are views showing paper length indications scribed on a recording paper table according to the present invention.
Figure 10:
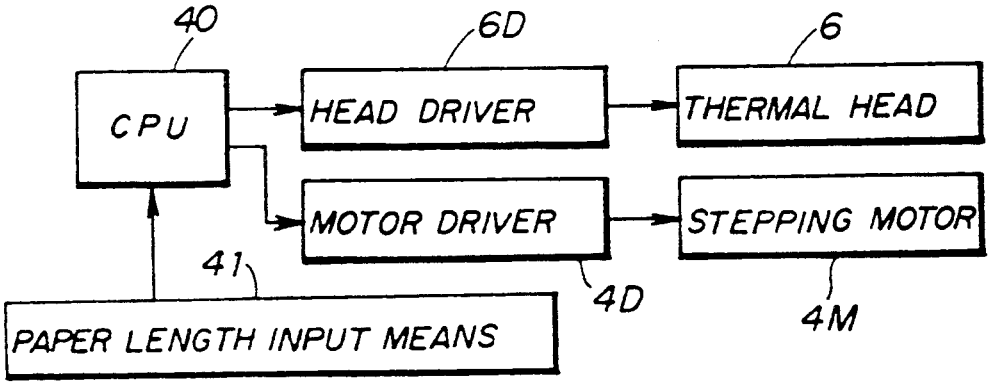
FIGS. 10 and 11 are a system block chart and a flow chart, respectively, for explaining the operation of the recording paper length sensing apparatus as shown in FIG. 6.
Figure 11:
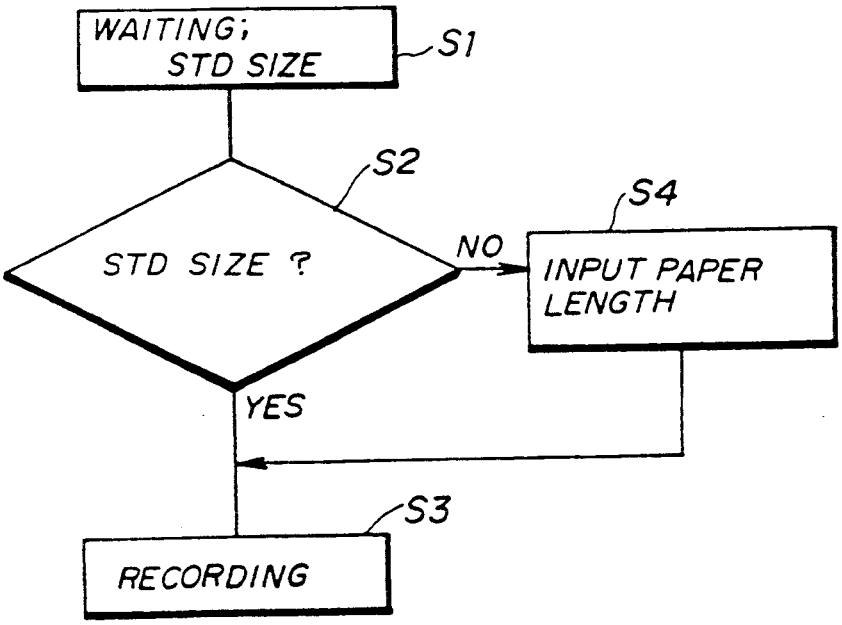

Next, a description will be given of a modified example of the recording paper length sensing apparatus according to the present invention, with reference to FIGS. 6A, 6B, 10 and 11. FIGS. 6A, 6B and 6C are a top view of a recording paper table 2 on which a few different paper size indications are provided, respectively. In FIG. 6A, standard paper length indication lines 32 are scribed on the recording paper table 2, and, in FIGS. 6B and 6C, non-standard paper length indication lines 32 which are different from the standard paper length indication lines are scribed on the recording paper table 2. The non-standard paper length indication lines shown in FIG. 6B are in millimeters, and the non-standard paper length indication lines in FIG. 6C are in inches. FIG. 10 shows a system block chart for explaining the operation of the modified recording paper length sensing apparatus. In this embodiment, there is provided a paper length input means 41 for an operator to input a length of recording paper to be loaded on the recording paper table 2 to a CPU 40, and this paper length input means 41 may be an operation board provided on a surface of the image forming apparatus. When the length of recording paper being loaded on the recording paper table 2 is known prior to using the image forming apparatus, an operator can easily input the known length of the recording paper from the paper length input means 41, and a signal indicative of the recording paper length thus inputted is supplied to the CPU 40 so that the recording part of the image forming apparatus carries out appropriately a thermal transfer of an image to the recording paper. FIG. 11 shows a flow chart for explaining the operation of the CPU 40 in this case. In FIG. 11, a step S1 indicates that the CPU 40 normally is set in a waiting state with a setting of standard paper size. A step S2 makes a decision on whether the length of recording paper being loaded on the recording paper table 2 is equal to the standard paper length setting or not. If the recording paper length or not. If the recording paper length is the same as the standard paper length setting, then a step S3 makes the recording part of the image forming apparatus perform a thermal transfer of an image onto the recording paper. If the recording paper length is found not to be the standard paper length setting, then a step S4 requests an operator that the length of the recording paper being actually loaded on the recording paper table 2 should be inputted from the paper length input means 41 on the image forming apparatus. After the operator inputs the length of the recording paper, a signal indicative of the recording paper length is supplied to the CPU 40, then the above described step S3 is carried out for an appropriate thermal transfer of an image to the recording paper.

As described in the foregoing, it is possible to detect the length of recording paper of any size, even a non-standard paper size, which is loaded on the recording paper table according to the present invention, and it is unnecessary to use several paper cassettes each having a predetermined specific size. Consequently, the image forming apparatus no longer requires a plurality of paper feeding mechanisms for several recording paper sizes and a plurality of paper cassette mounting inlets for several paper cassettes of different sizes. In the present invention, the length of recording paper is detected with a single recording paper table. This allows a smaller size of the apparatus and a reduction of the manufacturing cost. If is advantageous that the recording paper length sensing apparatus according to the present invention can be used regardless of whether the recording paper to be loaded has a standard paper size or not. In addition, when the length of recording paper being loaded on the recording paper table is already known, an operator can input the known length to the CPU of the image forming apparatus so that a recording is carried out appropriately on the recording paper in accordance with the length.

Further, the present invention is not limited to the above embodiment, and modifications and variations may be made without departing from the scope of the present invention.

What is claimed is:

1. A recording paper length sensing apparatus for sensing a length of recording paper being fed along a paper feeding path to an image forming apparatus for recording an image on the recording paper, said recording paper length sensing apparatus comprising:

table means on which the recording paper is loaded, the table means having a movable member and a fixed member and being mounted to a portion of the image forming apparatus to supply the recording paper along the paper feeding path to the image forming apparatus, the movable member being adjustable relative to the fixed member to position an end portion of said movable member in accordance with the recording paper edge;

switching means for detecting a predetermined position of the movable member, the switching means being turned ON to generate a signal indicative of the length of the recording paper when the predetermined position of the movable member is detected;

control means responsive to the signal from the switching means for allowing the image forming apparatus to recognize the length of the recording paper being loaded on the table means prior to the recording of the image on the recording paper; and paper length input means for inputting a paper length to the control means, so that the control means recognizes the length of the recording paper with the paper length input regardless of whether the control means receives the signal from the switching means or not.

2. The recording paper length sensing apparatus as claimed in claim 1, wherein the switching means comprises a plurality of sensing devices being provided at predetermined intervals on a front side surface of the table means on which the recording paper is loaded, said plurality of sensing devices being aligned in a row on the table means along the paper feeding path.

3. The recording paper length sensing apparatus as claimed in claim 2, wherein the control means, responsive to a combination of signals supplied from said plurality of sensing devices generated when the predetermined position of the movable member is sensed, recognizes the length of the recording paper.

4. The recording paper length sensing apparatus as claimed in claim 1, wherein the switching means comprises a plurality of sensing devices provided at predetermined intervals on a reverse side surface of the table means and aligned in a row on the table means along the paper feeding path.

5. The recording paper length sensing apparatus as claimed in claim 4, wherein the control means, responsive to a combination of signals supplied from said plurality of sensing devices generated when the predetermined position of the movable member is sensed, recognizes the length of the recording paper.

* * * * *